US005912687A

United States Patent [19]

Cowger et al.

[11] Patent Number: 5,912,687

[45] **Date of Patent: *Jun. 15, 1999**

[54] INK SUPPLY SYSTEM FOR A PRINTER

[75] Inventors: Bruce Cowger; Ronald E. Prevost, Jr., both of Corvallis, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/489,852

[22] Filed: Jun. 13, 1995

Related U.S. Application Data

[63] Continuation-in-part of application No. 08/220,767, Mar. 30, 1994, Pat. No. 5,742,308.

[51] Int. Cl.[6] ..... B41J 2/175

[52] U.S. Cl. ..... 347/85; 251/353

[58] Field of Search ..... 347/85, 86, 87, 347/7; 251/353, 354

[56] References Cited

U.S. PATENT DOCUMENTS

| | | | |
|---|---|---|---|
| 3,026,903 | 3/1962 | Roach | 137/533 |
| 4,156,244 | 5/1979 | Erikson et al. | 347/86 |
| 4,178,595 | 12/1979 | Jinnai et al. | 347/7 |
| 4,266,250 | 5/1981 | Heinzl et al. | 358/493 |
| 4,323,907 | 4/1982 | Italiano | 347/85 |
| 4,368,478 | 1/1983 | Koto | 347/86 |
| 4,383,263 | 5/1983 | Ozawa et al. | 347/86 |
| 4,598,729 | 7/1986 | Naito et al. | 137/116.5 |
| 4,677,447 | 6/1987 | Nielsen | 347/87 |
| 4,677,448 | 6/1987 | Mizusawa et al. | 347/85 |
| 4,714,937 | 12/1987 | Kaplinsky | 347/86 |
| 4,831,389 | 5/1989 | Chan | 347/86 |
| 4,885,595 | 12/1989 | Kaplinsky et al. | 347/85 |
| 4,931,812 | 6/1990 | Dunn et al. | 347/87 |
| 4,940,997 | 7/1990 | Hamlin et al. | 347/87 |
| 4,967,207 | 10/1990 | Ruder | 347/7 |
| 4,973,993 | 11/1990 | Allen | 347/7 |
| 5,146,243 | 9/1992 | English et al. | 347/29 |
| 5,153,612 | 10/1992 | Dunn et al. | 347/87 |
| 5,185,614 | 2/1993 | Courian et al. | 347/24 |

FOREIGN PATENT DOCUMENTS

| | | | |
|---|---|---|---|
| 536 980 | 4/1993 | European Pat. Off. . | |
| 1145105 | 10/1957 | France | 251/354 |
| 3401071 | 7/1985 | Germany | 347/86 |
| 6-8463 | 1/1994 | Japan | 347/85 |

OTHER PUBLICATIONS

Greene et al.; Constant–Pressure Head Ink Supply; IBM Technical Disclosure Bulletin; p. 2898, Feb. 1973.

*Primary Examiner*—N. Le
*Assistant Examiner*—Judy Nguyen

[57] ABSTRACT

An apparatus and method for supplying ink to a multiple printhead ink pen within a printer. Each of a plurality of stationary ink cartridges has a nozzle for refilling an associated reservoir in the ink pen. The pen moves into registration with a nozzle associated with the particular reservoir requiring refilling. A pressurizer pressurizes all of the ink cartridges in unison. A yoke extends along the cartridges to hold all of the nozzles, and advances all of the nozzles so that the associated nozzle couples with the pen reservoir. A valve in the associated nozzle is opened by the coupling with the pen to initiate ink flow into the reservoir. Valves in the uncoupled nozzles remain closed. The valve in the associated nozzle automatically closes when all of the nozzles are retracted by the yoke at the end of the refilling operation.

21 Claims, 10 Drawing Sheets

INK SUPPLY SYSTEM FOR A PRINTER

BACKGROUND AND SUMMARY OF THE INVENTION

This application is a continuation-in-part of U.S. patent application Ser. No. 08/220,767, filed Mar. 30, 1994, U.S. Pat. No. 5,742,308.

TECHNICAL FIELD

This invention relates to ink-jet printers, and more particularly, to a printer with one or more stationary ink cartridges that refill the ink reservoirs on an ink-jet pen during normal operation.

Application Ser. No. 08/220,767 pertains to refilling a foam-filled reservoir of an ink-jet pen. That reservoir refilling operation commences once a selected number of ink drops have been ejected from the pen by the print head. The pen is moved by a carriage into registration with an ink cartridge that holds a relatively large amount of ink. An ink nozzle and compression member extend from the ink cartridge and push against the foam that is housed within the pen reservoir. A nozzle valve opens in response to an actuation signal thereby to commence a flow of ink through the nozzle into the foam.

When the compressed foam becomes saturated, the excess, overflowing ink is detected by a sensor within the reservoir. The sensor signals stoppage of the refilling operation. The nozzle valve then closes and the nozzle is withdrawn from the foam, the foam expands to absorb excess ink and to return to an undersaturated state so that the capillarity of the foam prevents ink drool from the pen.

The present invention provides a supply system that includes a stationary ink cartridge having a connected, movable ink nozzle. The pen to be refilled moves into registration with the nozzle. A positive pressure is established in the stationary ink cartridge, and the nozzle is advanced to protrude into the pen reservoir. The nozzle opens on contact with the pen for replenishing the reservoir. After a predetermined refill period, a back pressure is established in the stationary ink cartridge so that the nozzle will suck up any excess ink. The nozzle is then withdrawn from the reservoir. The nozzle valve automatically closes as the nozzle is withdrawn from the pen.

Another aspect of the invention includes a plurality of stationary ink cartridges with movable nozzles to refill multiple reservoirs of a multiple printhead pen. A refilling operation is carried out when a depleted pen reservoir is moved into registration with a nozzle. A yoke holding all of the nozzles advances all of the nozzles in unison so that the associated nozzle couples with the reservoir. The valve of the nozzle that is registered with the reservoir is opened by the coupling with the pen, thereby to initiate ink flow. That valve automatically closes when the nozzles are retracted by the yoke at the end of a refilling operation.

DETAILED DESCRIPTION OF A PREFERRED EMBODIMENT

Figure 1:
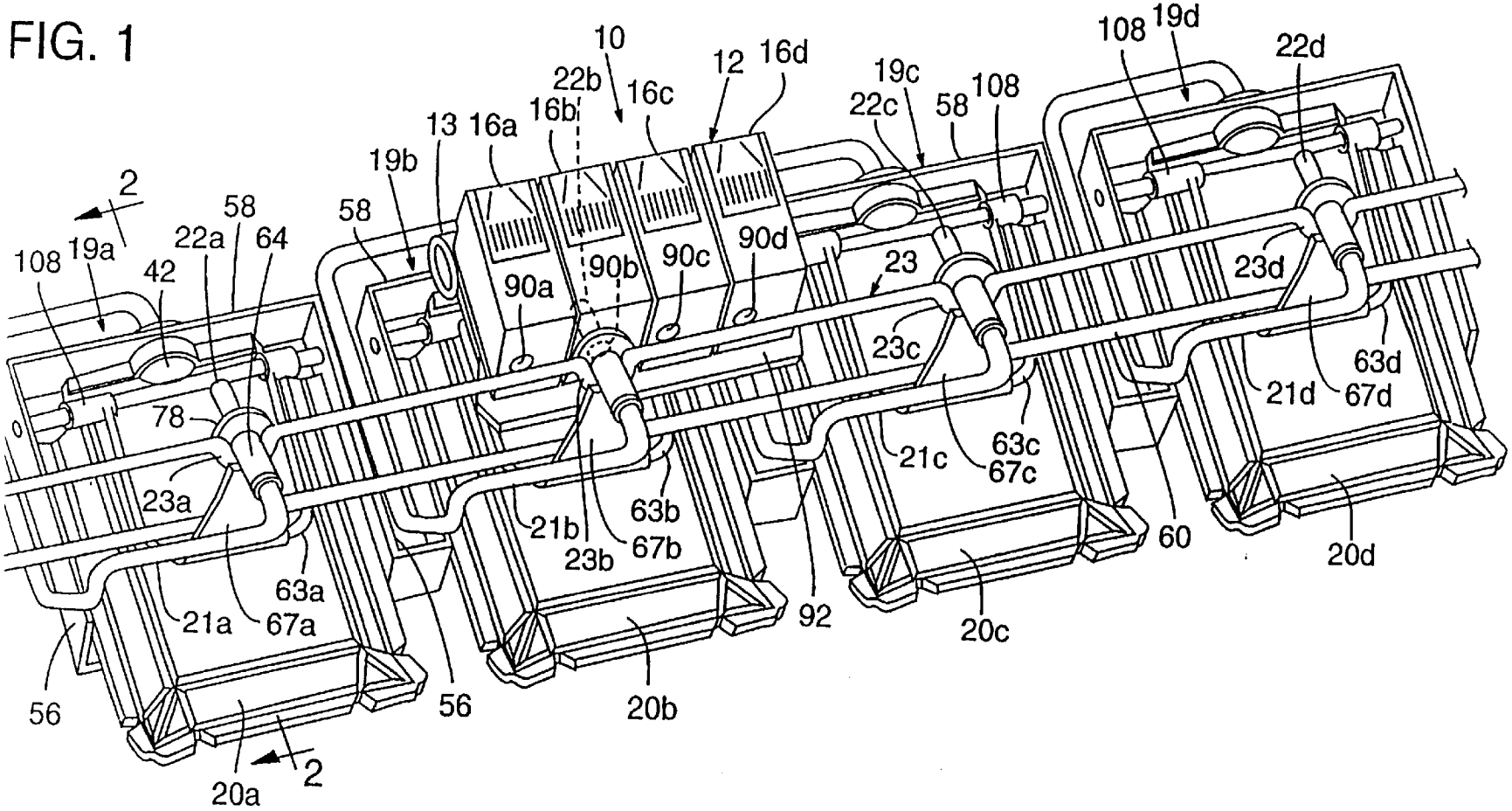
FIG. 1 is a perspective view of an ink supply system for a multiple printhead pen in accordance with one aspect of the invention.
Figure 4A:
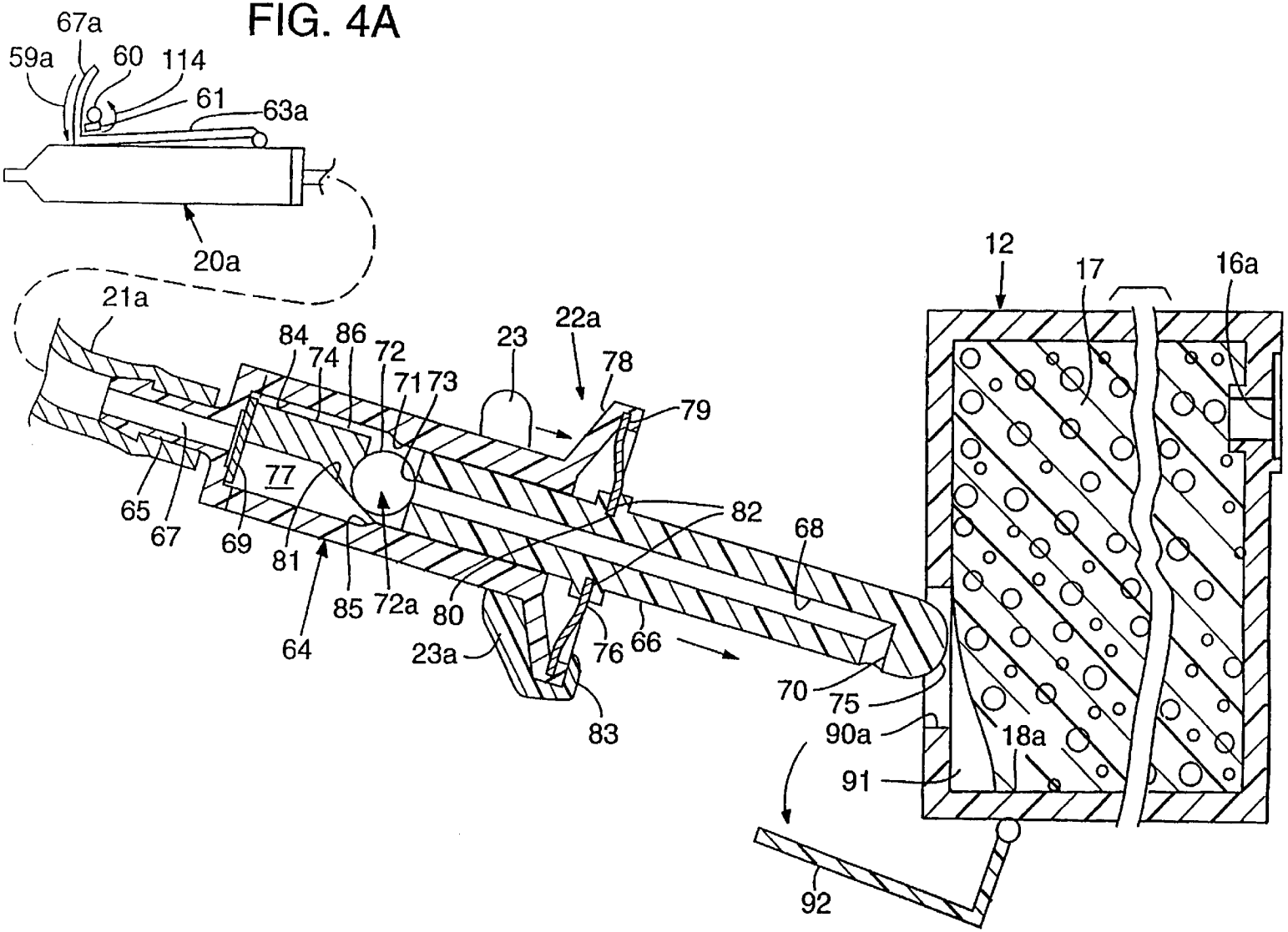
FIGS. 4A–4D are cross-sectional views of the nozzle, ink pen and ink cartridge in different stages of refilling the ink pen.
Figure 5:
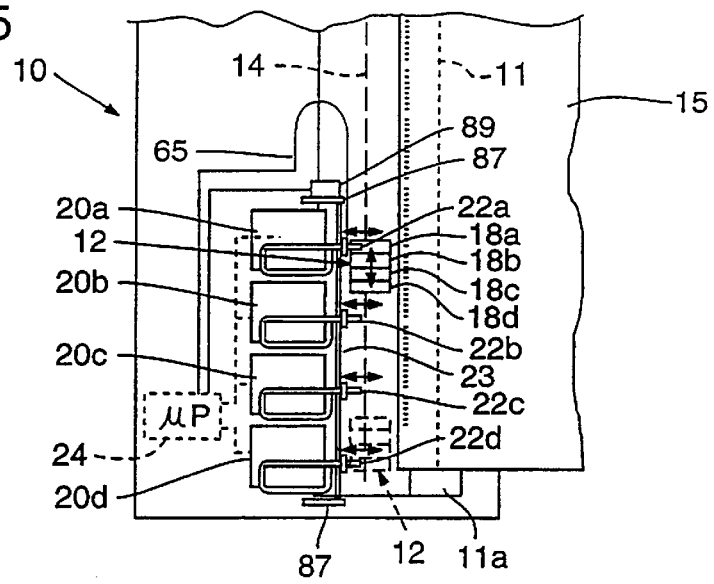
FIG. 5 is a schematic, top plan view of a printer that houses the ink supply system shown in FIG. 1.

FIGS. 1 and 5 show an ink supply system 10 for a color printer. A multiple printhead pen 12 is mounted on a carriage 13 for reciprocating movement along a linear path 14 (FIG. 5) adjacent a sheet of print media 15, such as paper. The print media 15 is moved on a platen 11 that is rotated by a platen motor 11*a*. The pen 12 may be integrally constructed or be constructed of a series of separate, single-print head pens positioned together. The pen 12 has four printheads 16*a*, 16*b*, 16*c*, 16*d* which are respectively in fluid communication with four small ink reservoirs 18*a*, 18*b*, 18*c*, 18*d*. Selectively fired resistors in each printhead vaporize quantities of ink to eject droplets for printing. As shown in FIG. 4A, the reservoirs are filled with open-cell hydrophilic foam 17, or other capillary media, such as small, closely packed elastomeric balls or bundles of elastomeric fibers.

The pen 12 is not continuously connected to an external supply of ink, and each reservoir 18*a*, 18*b*, 18*c*, 18*d* carries only a limited supply of ink. Thus, periodic refilling is required. In this case (see FIGS. 1 and 5), four ink supply cartridges 20*a*, 20*b*, 20*c*, 20*d* are positioned in stations 19*a*, 19*b*, 19*c*, 19*d* along the pen path 14. The cartridges normally contain cyan, yellow, magenta and black ink, respectively, for supplying the respective reservoirs 18*a*, 18*b*, 18*c*, 18*d* in the ink pen.

Flexible ink supply tubes 21*a*, 21*b*, 21*c*, 21*d* extend from the respective cartridges to deliver ink to the pen 12. Nozzles 22*a*, 22*b*, 22*c*, 22*d* are mounted at the free ends of the tubes. The nozzles are fit into a yoke 23 that can move toward and away from the path 14 of the pen 12.

The pen 12 is movable into registration positions along the linear path 14 such any one nozzle may couple with its respective pen reservoir as the nozzles are advanced by the yoke 23. As shown in FIG. 5, a printer microprocessor 24 controls the printing and refill functions as described below.

All of the cartridges 20*a* 20*b*, 20*c*, 20*d*, and attendant stations, tubes, and nozzles are substantially identical. The reservoirs 18*a*, 18*b*, 18*c*, 18*d* of the multiple printhead pen are also substantially identical. Thus, for simplicity, only the cartridge 20*a*, station 19*a*, tube 21*a*, nozzle 22*a*, and ink pen reservoir 18*a* will be described in detail.

Figure 2:
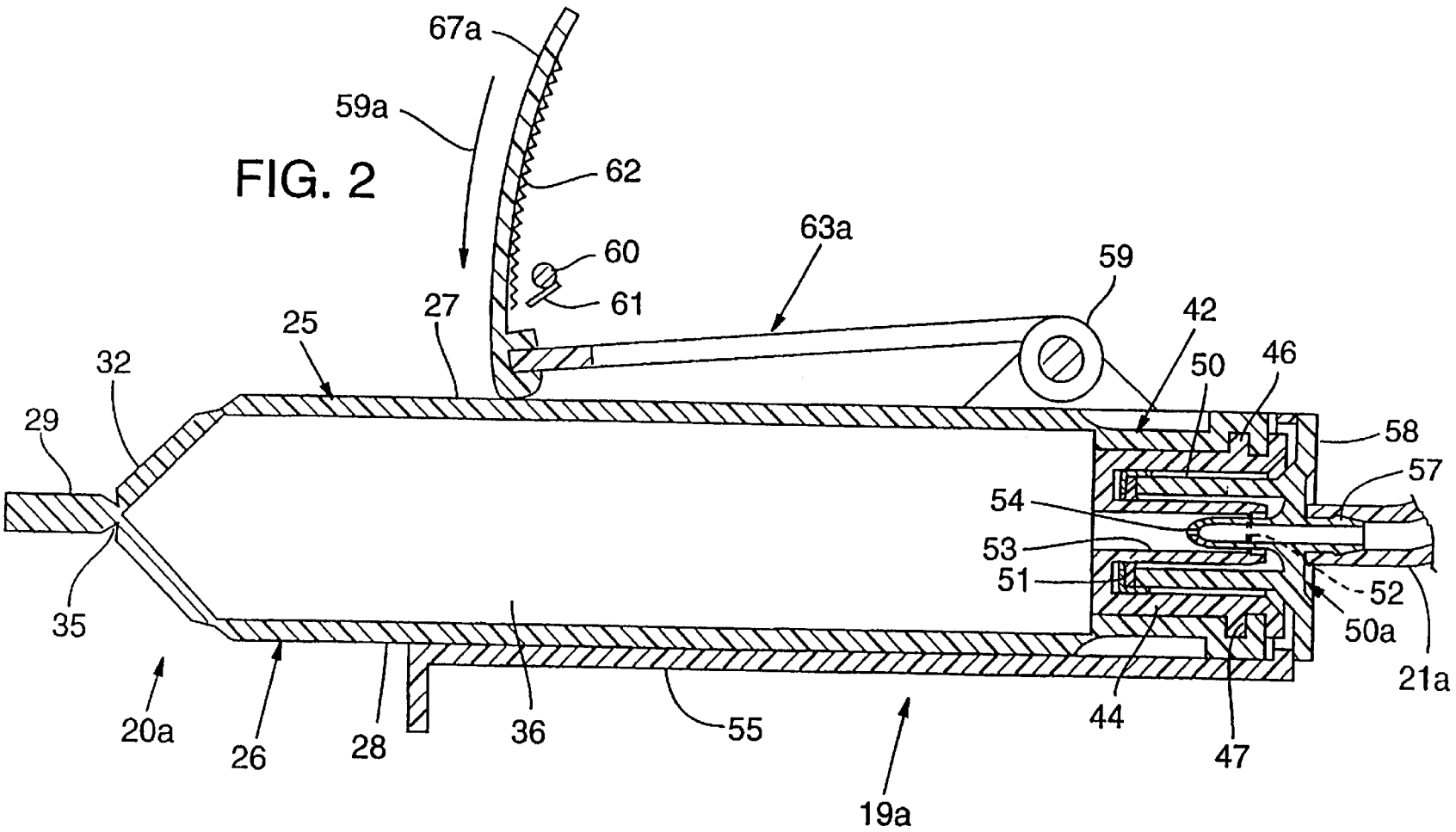
FIG. 2 is a partial cross-sectional view taken along line 2—2 in FIG. 1.
Figure 3:
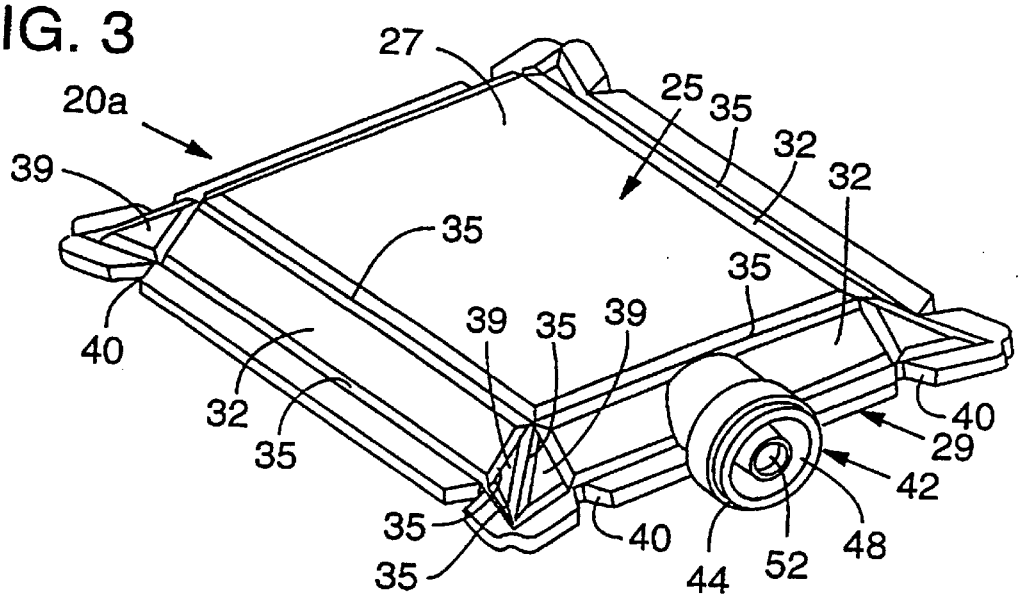
FIG. 3 is a perspective view of the ink cartridge of FIG. 1.

As shown in FIGS. 2 and 3, the ink supply cartridge 20*a* includes two substantially identical opposing upper and lower panel assemblies 25, 26. The panel assemblies respectively include a relatively large, square-shaped planar upper panel 27, and a lower panel 28, that define the top and bottom of the cartridge 20*a*.

The panel assemblies 25, 26 are joined at a square-shaped frame 29 and are symmetrical about a central plane defined by the frame. A hinge member 32 is located between each edge of the upper and lower panels 27, 28 and the corresponding edge of the frame 29. The junctions of the frame 29 with the hinge members 32 and the junctions of the upper and lower panels 27, 28 with the hinge members include grooves that define flexible hinges 35. The hinges facilitate movement of the upper panel 27 and lower panel 28 toward each other as the cartridge 20*a* collapses due to depletion of ink from the interior cavity 36 of the cartridge.

A pair of triangular-shaped hinge members 39 and associated hinges 35 join the ends of the hinge members 32 at each of the four corners of the frame 29. Notches 40 are formed in the frame 29 to permit a slight expansion of the frame that occurs as the cartridge collapses.

One side of the frame 29 includes a fitment 42 through which ink may be conducted into and out of the ink cartridge. The fitment 42 includes a cylindrically shaped sleeve 44 that is bonded, as by heat welding, into a correspondingly shaped opening that is molded into the frame 29. In this regard, the frame is essentially bifurcated to receive the cylindrical sleeve 44. In a preferred embodiment, the sleeve has an annular tongue 46 that fits into a rabbet groove 47 formed on the inside of the bifurcated portion of the frame. A spout 53 extends axially within the sleeve. The spout 53 has one end that is open to the cartridge cavity 36 and an opposing end that forms a pierceable septum 52.

As best seen in FIGS. 1 and 2, the fitment 42 mates with a coupler 50*a* when the cartridges 20*a*, 20*b*, 20*c*, 20*d* are placed by the user into respective stations 19*a*, 19*b*, 19*c*, 19*d* that are positioned along the linear path 14. Exemplary station 19*a* includes a bottom wall 55, opposed side walls 56 and an end wall 58. The coupler 50*a* is mounted to the end wall 58.

The cartridge is placed into the station with the fitment 42 facing the coupler 50*a*. The coupler includes a tubular connector 50 that protrudes into the station 19*a* to receive the cartridge fitment spout 53. A resilient sealing ring 51 mounted within the connector 50 seals around the spout 53, and a hollow needle 54 extending within the connector 50 pierces the cartridge septum 52 when the cartridge is placed within the station. The needle 54 is in fluid communication with the tube 21*a*, which is mounted to a fitment 57 extending from the coupler 50*a*.

The ink cartridges 20*a*, 20*b*, 20*c*, 20*d* are pressurized in order to move ink from the cartridges through the tubes to refill the reservoirs. As shown in FIGS. 1 and 2, a preferred pressurizer includes spring-biased pressure bars 63*a*, 63*b*, 63*c*, 63*d*, which are carried by respective pen stations 19*a*, 19*b*, 19*c*, 19*d*. The pressure bars are attached to the stations at spring hinges 59, and have upwardly curved flags 67*a*, 67*b*, 67*c*, 67*d* at their respective free ends. As shown in FIG. 2, spring hinge 59 urges the exemplary pressure bar 63*a* toward the bottom wall 55 of the station 19*a* (see directional arrow 59*a*), thereby forcing together the upper and lower panels 27, 28 of the cartridge.

The pressurization of the cartridges is selectively relieved by a rotatable pressurization shaft 60. The shaft 60 extends along the flags 67*a*, 67*b*, 67*c*, 67*d* and is equipped with pawls 61 that register with respective flags to retract all of the pressure bars 63*a*, 63*b*, 63*c*, 63*d* in unison. Referring to FIG. 2, exemplary pawl 61 is rotatable (clockwise in FIG. 2) into engagement with one of a row of teeth 62 that extend lengthwise along the concave surface of the curved flag 67*a*. The row of teeth 62 is oriented such that the teeth are always adjacent the pawl 61 as the flag 67*a* moves downwardly in response to the flattening of the ink cartridge. Thus, the pawl 61 is always engageable with a tooth to retract the pressure bar away from the ink cartridge. Removal of the bar force permits the cartridge to resiliently expand, thereby establishing a back pressure that prevents ink leakage.

As shown in FIGS. 4A–4D, exemplary nozzle 22*a* controls the flow of ink from the pressurized cartridge 20*a*. The nozzle 22*a* includes a nozzle base 64 with a bore 71. A hollow tube fitting 65 defining a fitting bore 67 extends from the base for attachment within the distal end of the flexible tube 21*a*. The fitting bore 67 opens into the base bore 71. The fitting bore 67 is covered by fine-meshed screen 69 that is mounted at the bottom of the nozzle base bore 71. The screen 69 permits the flow of ink therethrough while being sufficiently fine to block the passage of air bubbles when wet.

The nozzle base bore 71 telescopically houses an elongate nozzle portion 66. The nozzle portion 66 has an ink-conducting central passage 68 with an inlet 73 that opens into the bore 71. The central passage 68 extends axially through the nozzle portion to an outlet 70 that extends laterally downward from the central passage 68. The outlet 70 is spaced from the free end 75 of the nozzle portion 66 so that ink may exit the outlet while the free end is pressed to slide the nozzle portion 66 into the nozzle base 64, as will now be described.

Pressing the nozzle portion free end 75 slides the portion 66 into the nozzle base 64 to open a valve 72*a*. In this regard, the central passage inlet 73 is normally sealed by a valve member configured as a ball 72, as shown in FIG. 4A. The ball 72 is seated within the bore 71 on a resilient pad 74, which is seated in a bottom portion 84 of the bore adjacent the screen 69 and urges the ball 72 against the inlet 73.

Figure 4B:
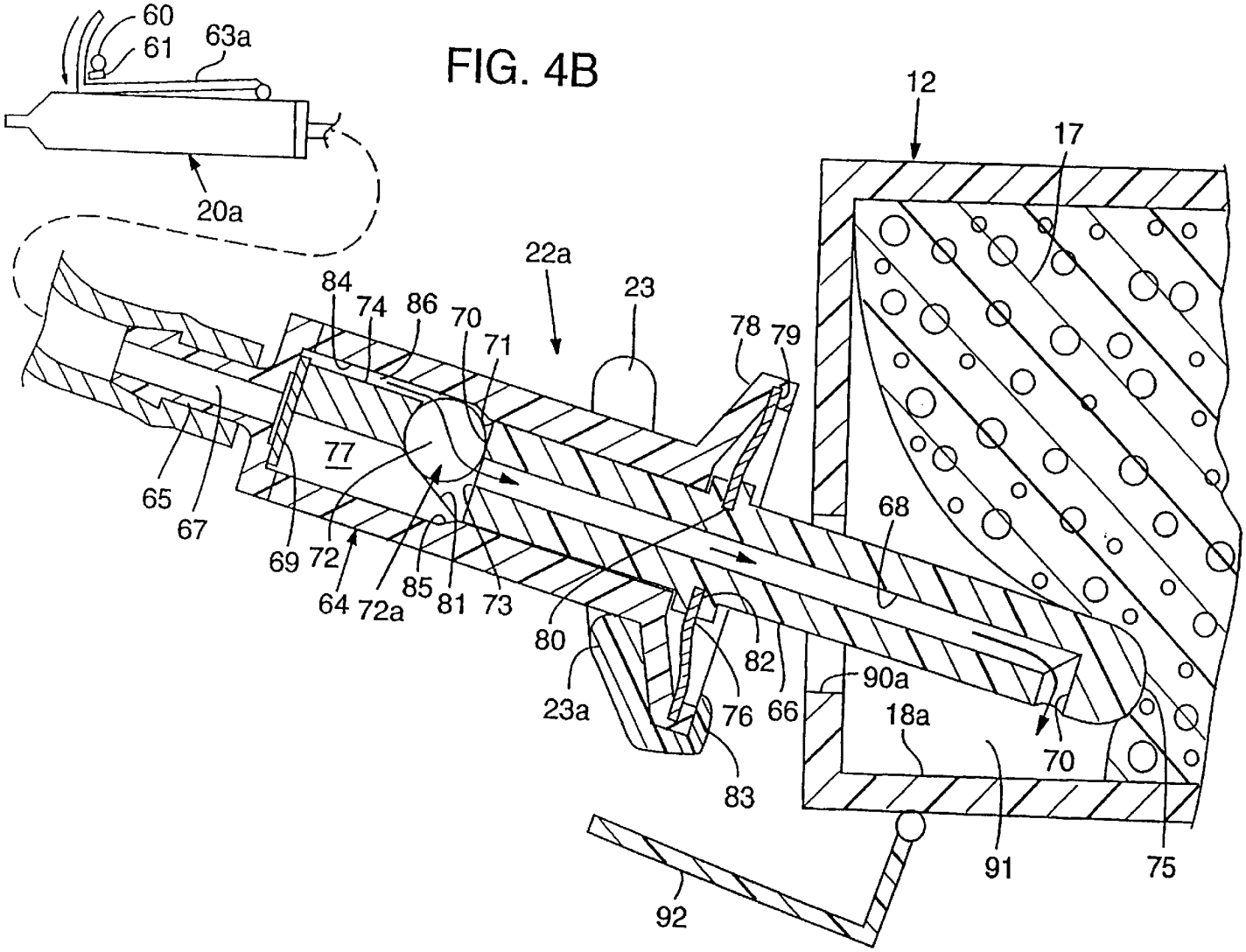

A cam 77 is also seated in the bore bottom portion 84 to deflect the ball 72 away from the inlet 73 when the nozzle portion 66 is pressed into the nozzle base 64. The cam 77 is a fin-like member with a cam surface 81 extending diagonally of the length of the bore 71. As shown in FIG. 4B, depression of the portion 66 into the nozzle base 64 moves the ball 72 along the diagonal cam surface 81 to compress the pad 74 and open the central passage inlet 73. In such a valve open position, ink flows through a gap 86 between the walls of the bore bottom portion 84 and the resilient pad 74 to enter the unsealed central passage 68.

In the embodiment illustrated in FIGS. 4A–4D, the bore diameter is increased at step 85, so that the bore bottom portion 84 has a relatively large diameter. As shown in FIG. 4B, the ball 72 moves along the cam surface 81 into the large diameter bottom portion 84 when the nozzle portion 66 is pressed into the nozzle base 64. The larger bore diameter permits the ball to move far enough from the passage inlet 73 to permit substantial ink flow therethrough. The diameter of the bore bottom portion 84 also promotes ink flow from the fitting bore 67 around the pad 74 and cam 77.

It is contemplated that the bore 71 could be of constant diameter as long as the ball 72 may move sufficiently to unseal the passage inlet, and as long as ink is permitted to flow around the pad and cam.

As shown in FIG. 4A, a disc-like diaphragm spring 76 biases the nozzle portion 66 toward the telescopically extended, closed valve position. The diaphragm spring 76 is held within an annular groove 79 defined in a flared distal portion 78 of the nozzle base 64. The diaphragm spring 76 is generally conical in shape and has an inner circular aperture 80 at the reduced-diameter end, through which extends the nozzle portion 66. The diaphragm spring 76 attaches into an external annular groove 82 on an intermediate portion of the nozzle portion 66. The reduced diameter end of the spring 76 projects distally, to hold the nozzle portion in a distally extended position. Pressing the portion 66 telescopically into the base portion 64 causes the spring 76 to resiliently deform (FIG. 4B).

While the preferred nozzle is telescopically extendable, it is also contemplated that other nozzle constructions with other relative motions between the nozzle and the nozzle base will work as well. For instance, the nozzle could be pivotally deflectable relative to the nozzle base to initiate ink flow.

As shown in FIG. 1, all the nozzles 22*a*, 22*b*, 22*c*, 22*d* are mounted to the yoke 23. The preferred yoke is an elongate rod with a series of U-shaped nozzle harnesses 23*a*, 23*b*, 23*c*, 23*d* to hold the individual nozzles. Referring to exemplary nozzle 22*a* in FIGS. 1 and 4A, the nozzle base portion 64 is snugly received between the legs and base of the U-shaped nozzle harness 23*a*. A clip portion 83 is carried by the harness 23*a* and extends from the nozzle harness base to attach over the flared portion 78 of the nozzle base to securely hold the nozzle within the harness.

As best shown in FIG. 5, the yoke 23 advances and retracts all the nozzles 22*a*, 22*b*, 22*c*, 22*d* in unison between the uncoupled and coupled positions. In the illustrated example, the yoke 23 is mounted at either end on actuator-driven, rotatable wheels 87. The wheels 87 may be rotated by an actuator motor 89 through a predetermined angle to advance the nozzles toward the pen, into a coupled position. The yoke actuation is identical for the coupling of each nozzle 22*a*, 22*b*, 22*c*, 22*d* with its associated pen reservoir 18*a*, 18*b*, 18*c*, 18*d*. For example, FIG. 1 shows the case where nozzle 22*b* is coupled with pen reservoir 18*b*, and FIG. 5 shows nozzle 22*a* coupled with reservoir 18*a*. It is contemplated that various other yokes and yoke actuation means may work equally as well.

As shown in FIG. 1, the ink pen 12 has four inlet apertures 90*a*, 90*b*, 90*c*, 90*d* that provide access for the nozzles 22*a*, 22*b*, 22*c*, 22*d* respectively into the pen reservoirs 18*a*, 18*b*, 18*c*, 18*d*. The pen is also provided with a shutter 92 that normally seals all of the inlet apertures to prevent ink evaporation from the reservoirs. As shown in FIGS. 1, 4A and 4D, the shutter 92 may be hinged across the pen so that all apertures 90*a*, 90*b*, 90*c*, 90*d* may be opened or closed by a single actuation of the shutter. The shutter 92 is actuated by a single motor (not shown) that may be carried by the carriage 13. The motor includes a drive arm that engages the edge of the shutter 92 to actuate the shutter. The shutter 92 actuation is identical for the refilling of each reservoir 18*a*, 18*b*, 18*c*, 18*d*.

Figure 6:
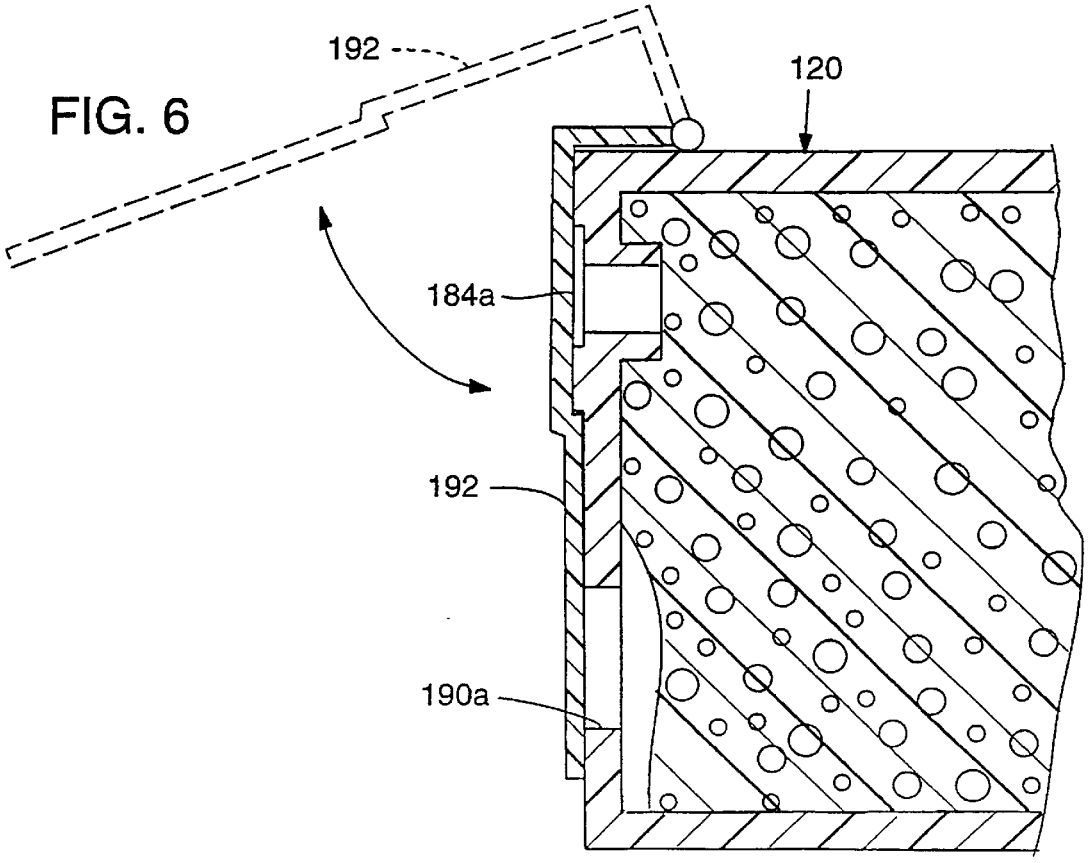
FIG. 6 is a cross-sectional view of an alternate ink pen in accordance with another aspect of the invention.

As shown in FIG. 6, in an alternative embodiment pen 120, an inlet aperture 190*a* and a printhead 184*a* are located on the same face of the pen, a single shutter 192 may protectively cover both the printhead and the aperture.

As shown in FIG. 4A, exemplary reservoir 18*a* has a free volume adjacent the inlet aperture 90*a* that is not occupied by the foam 17. The free volume is referred to as a "catch basin" 91 and holds ink that may overflow from the foam 17 during refilling. The catch basin 91 may be formed by shaping the foam to leave open a portion of the reservoir 18*a*, or by forming a recess in the pen reservoir wall.

Ink Refilling Operation

Figure 4C:
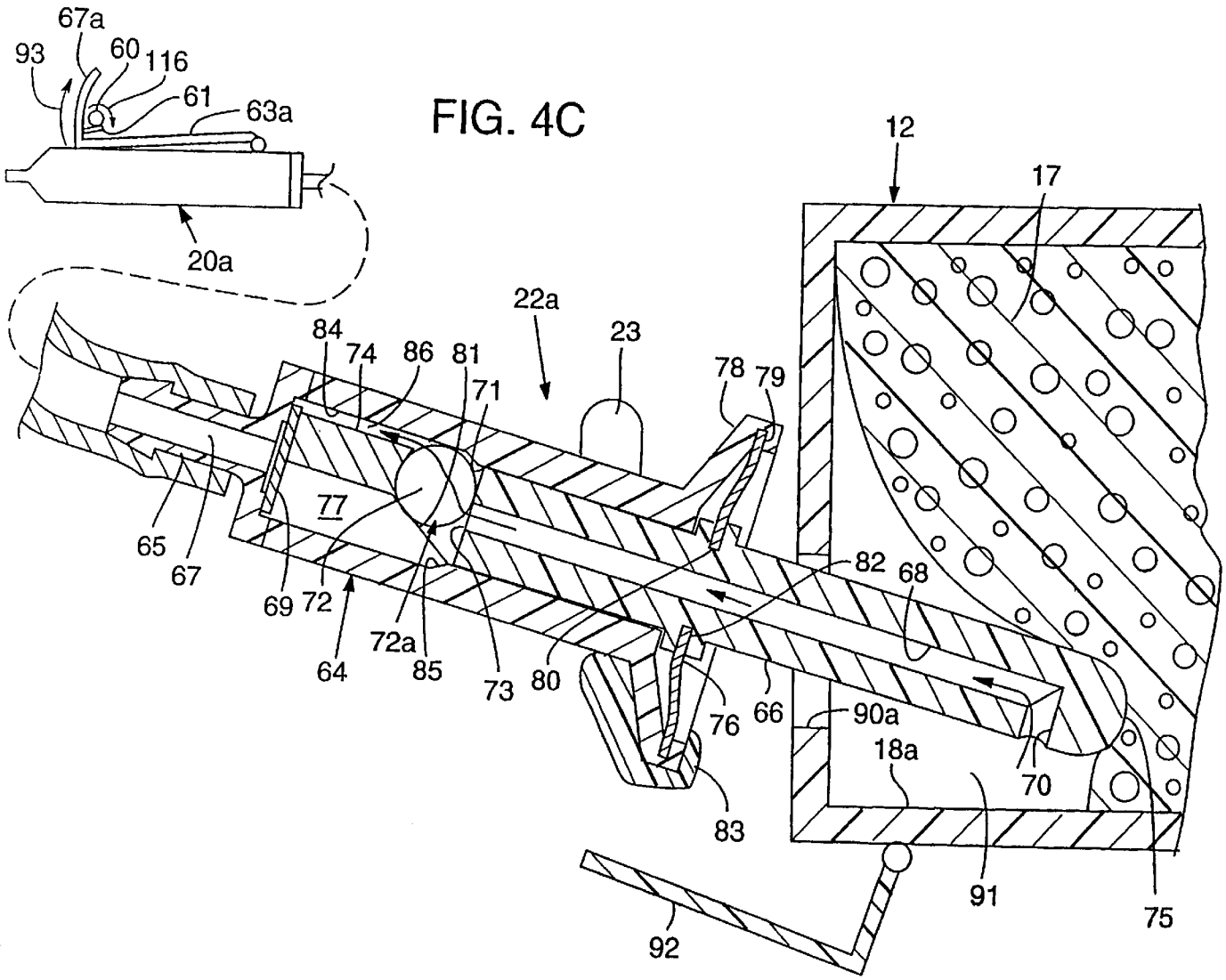
Figure 4D:
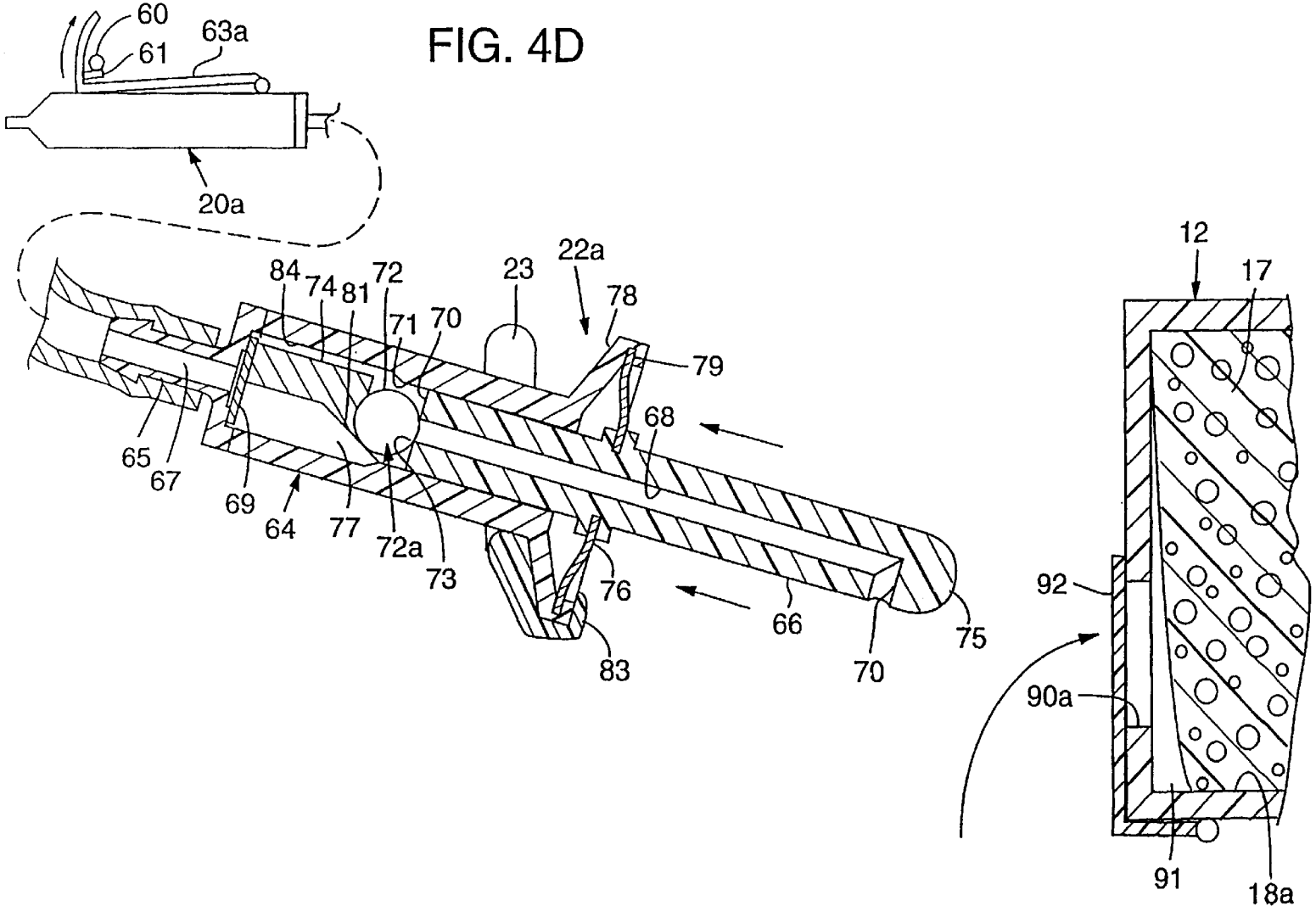

FIGS. 4A, 4B, 4C and 4D schematically illustrate the refilling operation. FIG. 4A shows coupling; FIG. 4B, ink refilling; FIG. 4C, ink suckback; and FIG. 4D, decoupling.

The microprocessor 24 (FIG. 5) records in memory the number of ink drops printed from each printhead. The refilling operation begins once the number of ink drops from any printhead exceeds a predetermined quantity. The predetermined quantity is calculated to ensure that a "safety margin" amount of ink will remain within the reservoir associated with such printhead, thereby to account for the uncertainties of ink usage, droplet size, evaporation, and to permit the printing of the remainder of a given page.

In this example, pen reservoir 18*a* is refilled. As shown in FIG. 5, the pen 12 is moved along the linear path 14 to a position where the reservoir inlet aperture 90*a* (FIG. 1) registers with nozzle 22*a*. Movement of the pen is controlled by conventional carriage mechanisms that are also used for moving the pen during printing. Referring to FIG. 4A, all of the ink cartridges 20*a*, 20*b*, 20*c*, 20*d* are pressurized in unison after the shaft 60 rotates in the direction of arrow 114 so that the pawls 61 release the pressure bars 63*a*, 63*b*, 63*c*, 63*d*.

The shutter 92 is then actuated to open the inlet apertures 90*a*, 90*b*, 90*c*, 90*d*. The yoke 23 is advanced to move the portion 66 of nozzle 22*a* through the uncovered aperture 90*a* into the reservoir 18*a* near the bottom of the reservoir.

Because the other nozzles 22*b*, 22*c*, 22*d* are not registered with their associated reservoirs, those nozzles remain uncoupled when the yoke 23 is advanced. That is, the free ends 75 of those nozzles do not contact the pen.

Referring to FIG. 4B, the ball valve 72*a* of coupled nozzle 22*a* opens as the free end 75 of the nozzle is pressed into the foam 17, as explained above. Ink flows from the pressurized cartridge 20*a* and exits downwardly through the nozzle outlet 70 into the reservoir 18*a* for absorption by the foam 17. Since the free ends of the uncoupled nozzles 22*b*, 22*c*, 22*d* are not engaged, the valves within those nozzles remain closed, and no ink flows therethrough.

The nozzle 22*a* is pressed against the foam 17 for a selected period of time that is based upon the flow rate of ink from the nozzle. The catch basin 91 provides a volume for collecting excess ink that is not absorbed by the foam 17.

One advantage of the catch basin 91 is that it permits construction of inexpensive nozzles 22*a* and ink supply cartridges 20*a*. Specifically, nozzles and ink cartridges producing somewhat variable ink flow rates will perform satisfactorily in the present ink supply system because the catch basin has the capacity to hold excess ink in the reservoir. Thus, the catch basin permits the nozzles and cartridges to be manufactured to less stringent standards, resulting in lower production costs.

Referring to FIG. 4C, the cartridges 20*a*, 20*b*, 20*c*, 20*d* are depressurized in unison at the end of the refill period. Depressurization occurs as the shaft 60 rotates in the direction of arrow 116 so that the pawls 61 lift the pressure bars 63*a*, 63*b*, 63*c*, 63*d* from the respective cartridges, in direction of arrow 93. Preferably, the cartridges are formed to resile into an expanded position once the pressure bars are retracted. The back pressure established by such expansion of the coupled ink cartridge 20*a* causes the nozzle to suck back into the passage 68 any free ink held in the catch basin 91. The cartridge 20*a* back pressure further causes ink near the outlet 70 of the nozzle passage 68 to be sucked deeper into the nozzle 22*a*. The suck back action of the nozzle leaves the foam exactly saturated.

As shown in FIG. 4D, the nozzles 22*a*, 22*b*, 22*c*, 22*d* are then retracted in unison by the yoke 23 into an uncoupled position. Retraction of the coupled nozzle 22*a* from the pen reservoir 18*a* permits the foam 17 to expand from the compressed state (FIG. 4C), and closes the ball valve 72*a*, as described above.

As the foam expands, it transforms from an ink saturated to an ink-undersaturated condition. Such undersaturation allows the capillarity of the foam to establish a back pressure within the reservoir, thereby preventing drooling of ink from the printhead 16*a*. The shutter 92 is then actuated to close the reservoir apertures.

It is contemplated that more than one nozzle advancement and retraction step may be required in a refill operation. If the catch basin is relatively small, or if the variation in the ink flow rate is relatively large, a plurality of nozzle advancement and retraction steps with relatively short ink flow periods may be necessary so that the catch basin will not be overfilled with unabsorbed ink.

Furthermore, it is contemplated that a cartridge pressurizer that pressurizes only the cartridge associated with the ink reservoir to be refilled will work as well.

Alternative Embodiment No. 1

Figure 7A:
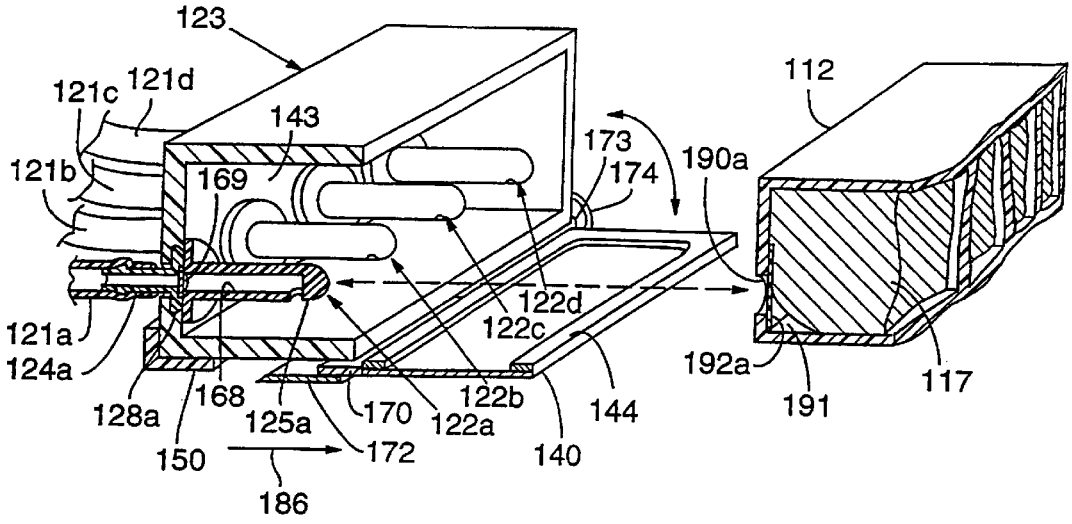
FIG. 7A is a cross-sectional, broken-away perspective view in accordance with another aspect of the invention.

FIG. 7A illustrates an alternative ink supply system, wherein all ink reservoirs in a multiple reservoir ink-jet pen are simultaneously refilled. Ink nozzles 122*a*, 122*b*, 122*c*, 122*d* are fixedly mounted within a movable humidity chamber 123. The nozzles are mounted in a closely spaced relationship such that each ink nozzle (e.g., 122*a*) registers with its associated pen reservoir inlet aperture (e.g., aperture 190*a*) when the ink pen 112 is in a preselected refilling position along the carriage path. The nozzles are connected through ink tubes 121*a*, 121*b*, 121*c*, 121*d* to ink cartridges such as those shown in FIG. 1.

As shown in FIG. 7A, the humidity chamber 123 is a box with a hinged front wall 140. The nozzles are mounted through the chamber back wall 143 and extend within the chamber. The front wall 140 has a peripheral gasket 144 to seal the chamber when the front wall is closed, thereby preventing dry-out of the nozzles. The humidity chamber 123 is mounted upon a chamber carriage 150 or the like. The carriage is driven by a mechanism described below, to advance the chamber along path 186 to couple the nozzles with the ink pen 112 during refilling.

The nozzles 122*a*, 122*b*, 122*c*, 122*d* shown in FIG. 7A do not include a valve mechanism. Rather, as will be discussed, the ink discharge is controlled solely by the compression of the ink cartridges 20*a*, 20*b*, 20*c*, 20*d* (FIG. 1). In FIG. 7A, exemplary nozzle 122*a* may be constructed of a fitting element 124*a* and a nozzle element 125*a* which may be heat-welded together. Fitting element 124*a* has a protruding annular lip 128*a* that snugly snaps into an annular groove defined within the back wall 143 of the humidity chamber 123. Nozzle element 125*a* extends from the back wall into the chamber. The elements 124*a*, 125*a* have bores that are aligned to form an ink passage bore 168 through the nozzle. To prevent air from being sucked-back into the ink cartridges, the bore 168 is covered by a fine-meshed screen 169 at the interface of the fitting and nozzle elements. The screen permits the flow of ink therethrough while blocking the passage of air bubbles when wet.

When at least one ink reservoir requires refilling, the ink pen 112 is moved along the carriage path to the refilling position wherein the reservoir apertures are registered with the nozzles 122*a*, 122*b*, 122*c*, 122*d*. The chamber front wall 140 has a tab 170 extending from the bottom edge thereof. The tab engages a fixed cam surface 172 as the chamber advances toward the pen 112. The cam and tab engagement rotates the front wall 140 about the hinge 173 to an open position parallel with the bottom wall of the chamber. The hinge 173 includes a clock spring 174 or the like that snaps the front wall back to the closed position when the chamber is retracted away from the cam.

The chamber 123 is advanced in direction 186 to slide over and substantially enclose the ink pen 112. The advancement of the humidity chamber inserts each nozzle into its associated ink reservoir. Each pen reservoir has a resilient shutter flap 192*a* that is heat-staked on the top of the flap to the inside of the chamber wall to ordinarily seal the aperture. The protrusion of the nozzles into the reservoirs inwardly deflects the flap and compresses the reservoir foam 117.

The cartridge pressurization shaft 60 (FIG. 1) is then actuated to compress the ink cartridges to initiate ink flow from the nozzles. The discharged ink is absorbed by the foam until saturation, at which point the ink flows into the reservoir catch basin 191. At the end of the refill period, the ink cartridges are depressurized, establishing a back pressure sucking back any free ink held in the catch basin. The humidity chamber is then retracted to uncouple the nozzles from the ink pen.

By proper selection of ink discharge rates, refill time, foam volume and absorbency, and catch basin volume, this alternative system performs well irrespective of pen ink level conditions. For instance, if the foam in one or more reservoirs is saturated at the onset of the refill operation, the ink discharged from the nozzle is rejected by the saturated foam and flows into the catch basin. The catch basin is large enough to contain the entire volume of ink discharged during a refill operation. The nozzles will then suck back the free ink held in the catch basin at the end of the refill operation.

On the other hand, when one or more ink reservoirs are empty, substantially all the ink discharged from the nozzle is absorbed by the foam, with little ink flowing into the catch basin. The nozzle screen 169 prevents air from being sucked into the ink supply tube during suck-back.

Figure 8:
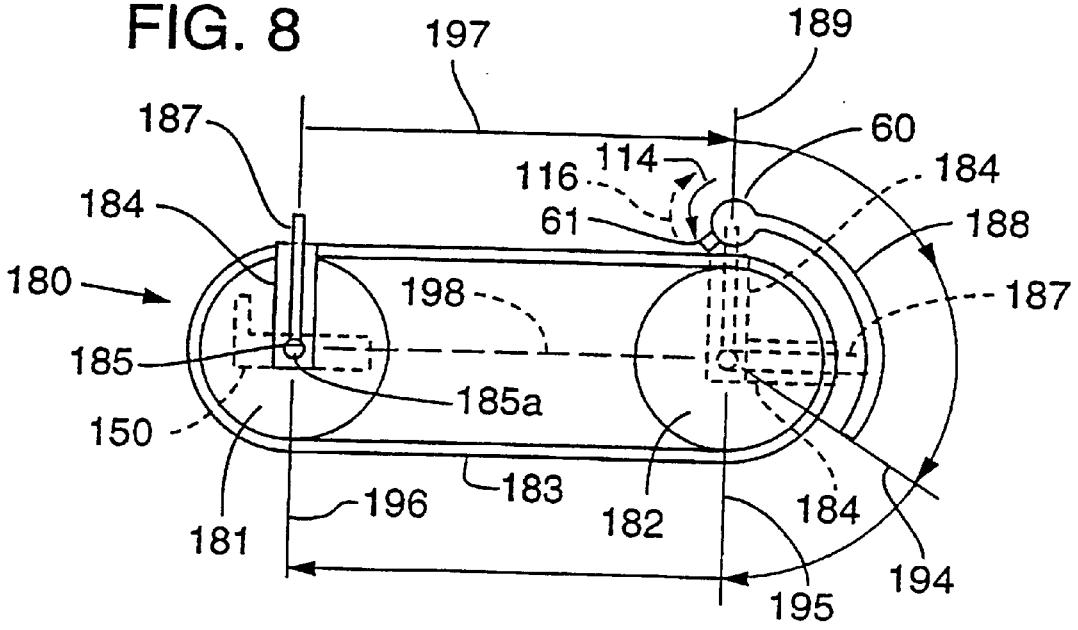
FIG. 8 is an elevational view of in accordance with another aspect of the present invention.

This alternative embodiment may include an advancement and pressurization mechanism 180, such as that shown in FIG. 8. The mechanism 180 is driven by the platen motor 11*a* (FIG. 5). The mechanism advances the chamber carriage 150 to couple the nozzles with the ink pen, pressurizes the ink cartridges for ink discharge, back-pressurizes the cartridges for ink suck-back, and retracts the chamber carriage to de-couple the nozzles at the end of the refill operation.

The mechanism includes a drive belt 183 that is trained about a pair of pulleys 181, 182. Pulley 182 is driven by the platen motor 11*a*, which may have a clutch mechanism to selectively drive either the platen 11 or the pulley 182.

As shown in FIG. 8, an elongate drag link 184 is attached to the belt and extends inwardly into the space defined by the trained belt. As the belt moves in direction 197, the link moves with the belt from pulley 81 to pulley 182, moves about pulley 182 in a rotating motion, moves from pulley 182 to pulley 181, and moves about pulley 181 in a rotating motion. The drag link has a bore 185 at its distal end in which a support shaft 185*a* is mounted. The shaft moves back and forth in a linear path 198 (parallel with direction 186 shown in FIG. 7A) as the belt moves. As the drag link moves about each pulley, the shaft 185*a* position remains static in registration with the center of the pulley, forming the center of rotation for the drag link. In other words, the shaft 185*a* intermittently advances and retracts along the linear path 198 as the belt moves, pausing at each end of the path.

The chamber carriage 150 (FIGS. 7A and 8) is mounted on the shaft 185*a* for advancement and retraction of the nozzles during a refilling operation.

The mechanism 180 also controls the pressurization of the ink cartridges. As shown in FIG. 8, the pressurization shaft 60 is positioned perpendicular and adjacent to the pulley 182. A shaft flag 188 curves from the shaft 60 along the periphery of pulley 182. A cam 187 extend s outwardly from the drag link to outwardly deflect the flag 188 (FIGS. 1 and 8) as the drag link moves about pulley 182. The deflection of the flag rotates the shaft 60 in direction 114 (FIGS. 8 and 4A), thereby pulling the pawls 61 away from their associated pressure bar flags 67*a*–67*d* as described above.

The cartridge pressurization and ink discharge initiate with the cam 187 contacting the shaft flag 188 at position 189 as the drag link begins movement about the pulley 182. Ink discharge continues until the drag link moves about pulley 182 to position 194, at which point the cam slips off the end of the shaft flag. The shaft 60 is spring biased to automatically rotate in direction 116 to re-engage the pawls with the pressure bar flags once the cam disengages. The resultant lifting of the pressure bars initiates suck-back, as discussed above. Suck-back continues with the nozzles coupled with the ink pen until the drag link moves to position 195 at the bottom of pulley 182. At position 195, the drag link begins to retract the chamber carriage 150 along path 198. The chamber carriage reaches the completely retracted position as the drag link reaches position 196 at the bottom of pulley 181. At this point, the refill operation is complete, and the platen motor 11*a* may disengage the pulley 182.

It is contemplated that a desired advancement distance, ink discharge time and suck-back time may be realized by appropriate selection of belt speed, pulley-to-pulley distance, pulley diameter, and shaft cam length.

It is to be understood that the advancement and pressurization mechanism 180 is exemplary only, and that a variety of other mechanisms accomplishing nozzle coupling and cartridge pressurization will work as well.

Alternative Embodiment No. 2

Figure 7B:
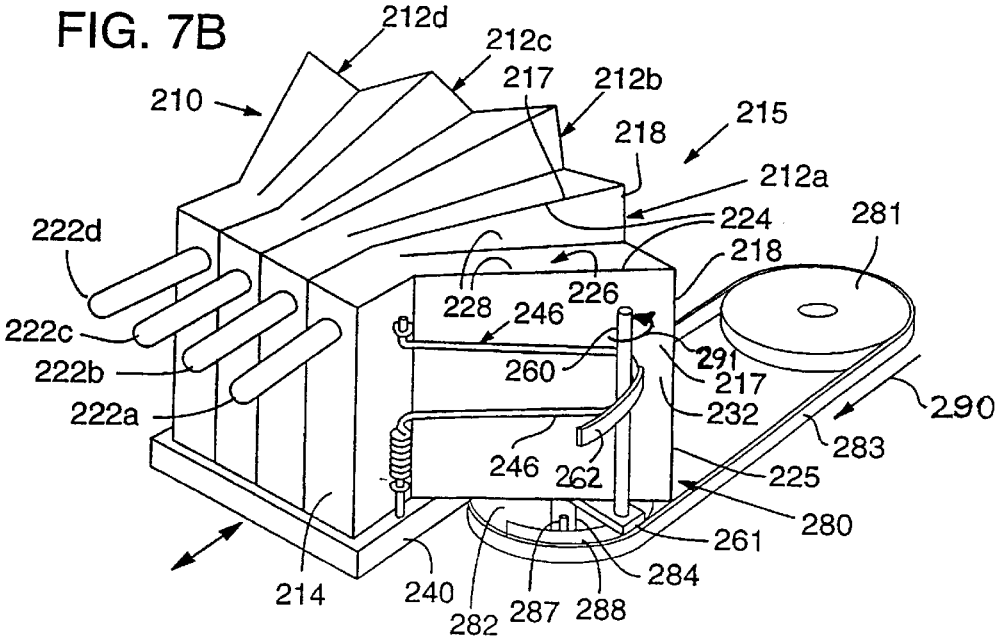
FIG. 7B is a perspective view in accordance with another aspect of the present invention.

FIG. 7B shows an alternative ink supply system similar to that of FIG. 7A. In FIG. 7B, collapsible ink subcartridges 212*a*, 212*b*, 212*c*, 212*d* are integrally formed in a flared "fan" shaped cartridge 210. Valves 222*a*, 222*b*, 222*c*, 222*d*, similar to those of the embodiment of FIG. 7A, rigidly extend from respective subcartridges. The entire cartridge 210 is mounted on an advanceable carriage 240, and ink is dispensed by a spring-biased actuator 246 that squeezes the entire fan-shaped cartridge.

The subcartridges have relatively thin base portions that are fixedly stacked together to form a relatively thin, non-compressible cartridge base 214 from which the valves extend. Each subcartridge has a pair of planar panels 217 that flair in a narrow V-shape from the base 214. The opposing panel edges 218 at the flared end of the V-shape, and the opposing upper panel edges 224 and lower panel edges 225 are connected by inwardly collapsible pleats 226 that are comprised of pairs of thin, hinged panels 228.

An advancement and pressurization mechanism 280 similar to that describes in relation to FIG. 8, controls the cartridge 210 advancement and retraction, and the cartridge pressurization. In this case, the pulleys 281, 282 lie in a horizontal plane, and the belt 283 moves in direction 290. A pressurization shaft 260 extends vertically from a support portion 261 of the carriage 240. The shaft carries a pawl that engages an actuator-mounted flag 262, as described relative to the embodiment shown in FIG. 2. A curved shaft flag 288 extends from a lower portion of the pressurization shaft 260. Outward deflection of the flag rotates pressurization shaft 260 in direction 291 to disengage the pawl from actuator flag 262, thereby permitting the is actuator 246 to pressurize the cartridge.

The shaft flag 288 extends in a horizontal plane just above the plane of pulley 282. Such flag positioning permits carriage advancement and retraction without the flag 288 interfering with the mechanism. The cam 287 extend s vertically upward from the drag link 284 to outwardly deflect the shaft flag as the drag link moves about pulley 282.

A second spring-biased actuator may be disposed on the opposite side of the fan-shaped cartridge. The second actuator may be a mirror image of the actuator 246. The pressurization shaft of the second actuator may be linked to the pressurization shaft 260 of the first actuator by a connector arm, or the like, in order to be actuated and deactuated simultaneously with the shaft 260. The cartridge 210 is preferably biased toward the full configuration to establish a back pressure when the cartridge actuator is released.

While the present invention has been described in accordance with preferred embodiments, it is to be understood that certain substitutions and alterations may be made thereto without departing from the spirit and scope of the following claims.

The invention claimed is:

1. In a printer, a method of refilling an ink jet pen that travels along a path and has an ink reservoir for storing ink, comprising the steps of:

providing a stationary ink cartridge adjacent the pen path, the cartridge having an ink-discharging nozzle extending therefrom;

providing a catch basin within the reservoir to hold excess ink that is discharged from the nozzle into the reservoir;

moving the ink pen along the path into registration with the nozzle;

coupling the nozzle and the ink pen to refill the pen reservoir with ink;

pressurizing the ink cartridge to permit the discharge of ink from the cartridge, through the nozzle, and into the pen reservoir;

depressurizing the ink cartridge after the reservoir is filled with the selected amount of ink;

establishing a back pressure within the ink cartridge to suck at least some of the excess ink held in the catch basin into the nozzle; and decoupling the nozzle and pen.

2. The method of claim 1 wherein the step of establishing said back pressure further includes blocking the passage of air bubbles through the nozzle which sucking said excess ink into the nozzle.

3. The method of claim 1, further including the steps of:

providing on the pen a shutter that is movable between a reservoir closed position and a reservoir open position to provide access to the reservoir;

moving the shutter to the reservoir open position prior to the coupling of the nozzle and pen; and moving the shutter to the reservoir closed position after decoupling of the nozzle and pen.

4. The method of claim 1 wherein the step of providing a stationary ink cartridge includes providing the nozzle with a valve having an open state and a closed state, and providing the nozzle with a compressible portion that is operable to open the nozzle valve when compressed, and wherein the step of coupling the nozzle and the ink pen includes moving the compressible portion of the nozzle into compressive engagement with the pen to open the valve as the nozzle couples with the pen.

5. An ink jet printer, comprising:

an ink jet pen that travels along a path, the pen comprising an ink reservoir for storing liquid ink, the ink reservoir housing a capillary member to absorb the liquid ink, and a catch basin formed within an interior of the pen and positioned to hold ink overflowing from the capillary member;

an ink cartridge disposed adjacent the pen path, the cartridge having an ink-discharging nozzle extending therefrom;

coupling apparatus for coupling the nozzle with the ink pen for ink replenishment and for decoupling the nozzle and the ink pen after ink replenishment;

a cartridge pressurizer for pressurizing the ink cartridge during ink replenishment to permit the discharge of ink form the cartridge, through the nozzle, and into the pen reservoir;

cartridge depressurizer apparatus for depressurizing the ink cartridge after the reservoir is filled with the selected amount of ink to establish a back pressure within the ink cartridge, whereby at least some of an excess ink quantity held in the catchbasin is sucked into the nozzle by use of the back pressure established in the ink cartridge.

6. The printer of claim 5 further including apparatus for allowing liquid ink being sucked from the pen to pass through the nozzle while preventing air from being sucked through the nozzle and into the ink cartridge.

7. The printer of claim 6 wherein said apparatus for allowing liquid ink being sucked from the pen to pass through the nozzle while preventing air from being sucked through the nozzle and into the ink cartridge comprises a fine-meshed screen mounted in the nozzle, said screen adapted to permit the flow of ink therethrough while being sufficiently fine to block the passage of air bubbles when wet.

8. The printer of claim 6 wherein the nozzle comprises a nozzle portion and a valve adjacent the nozzle portion, said valve having a normally closed state wherein ink is prevented from flowing through the nozzle and an open state wherein ink is permitted to flow through the nozzle, said valve adapted for actuation from the closed state to the open state by a coupling of the nozzle portion with the ink pen thereby to permit ink flow between the ink cartridge and the pen.

9. The printer of claim 5, wherein the coupling apparatus includes a yoke that holds the nozzle, the yoke being movable to advance the nozzle to couple the nozzle with the pen.

10. The printer of claim 5 wherein the ink cartridge includes first and second panels, and the pressurizer includes pressure bar apparatus for urging the first and second panels together to achieve said pressurization.

11. The printer of claim 10 wherein the cartridge depressurizer apparatus includes a structure connected to the pressure bar apparatus for retracting said pressure bar apparatus to permit the cartridge to resiliently expand, thereby establishing a back pressure in the ink cartridge.

12. An ink jet printer, comprising:

an ink jet pen comprising an ink reservoir for storing liquid ink, the ink reservoir housing a capillary member to absorb the liquid ink;

an ink cartridge having associated therewith an ink-discharging nozzle, the ink cartridge for holding a supply of liquid ink for replenishing said ink reservoir of the pen;

coupling apparatus for coupling the nozzle with the ink pen for ink replenishment and for decoupling the nozzle and the ink pen after ink replenishment;

a cartridge pressurizer for pressurizing the supply of ink held by the ink cartridge during ink replenishment to permit the discharge of ink from the cartridge, through the nozzle, and into the pen reservoir;

cartridge depressurizer apparatus for depressurizing the ink cartridge after the reservoir is filled with the selected amount of ink to establish a back pressure within the ink cartridge, whereby at least some of an excess ink quantity held in the pen is sucked into the nozzle by use of the back pressure established in the ink cartridge; and apparatus for allowing liquid ink being sucked from the pen to pass through the nozzle while preventing air from being sucked through the nozzle and into the ink cartridge.

13. The printer of claim 12 wherein said apparatus for allowing liquid ink being sucked from the pen to pass through the nozzle while preventing air from being sucked through the nozzle and into the ink cartridge comprises a fine-meshed screen mounted in the nozzle, said screen adapted to permit the flow of ink therethrough while being sufficiently fine to block the passage of air bubbles when wet.

14. The printer of claim 12 wherein the nozzle comprises a nozzle portion and a valve adjacent the nozzle portion, said valve having a normally closed state wherein ink is prevented from flowing through the nozzle and an open state wherein ink is permitted to flow through the nozzle, said valve adapted for actuation from the closed state to the open state by a coupling of the nozzle portion with the ink pen thereby to permit ink flow between the ink cartridge and the pen.

15. The printer of claim 12, wherein the coupling apparatus includes a yoke that holds the nozzle, the yoke being movable to advance the nozzle to couple the nozzle with the pen.

16. The printer of claim 12 wherein the ink cartridge includes first and second panels, and the pressurizer includes pressure bar apparatus for urging the first and second panels together to achieve said pressurization.

17. The printer of claim 16 wherein the cartridge depressurizer apparatus includes a structure connected to the pressure bar apparatus for retracting said pressure bar apparatus to permit the cartridge to resiliently expand, thereby establishing a back pressure in the ink cartridge.

18. In a printer, a method of refilling an ink jet pen having an ink reservoir for storing ink, comprising the steps of:

providing an ink cartridge having an ink-discharging nozzle extending therefrom;

providing relative motion between the ink cartridge and the ink pen to couple the nozzle and the ink pen for replenishing the pen reservoir with ink;

pressurizing the ink cartridge to permit the discharge of ink from the cartridge, through the nozzle, and into the pen reservoir;

depressurizing the ink cartridge after the reservoir is replenished with a quantity of ink from the ink cartridge;

establishing a back pressure within the ink cartridge to suck excess ink held in the pen into the nozzle; and decoupling the nozzle and pen.

19. The method of claim 18 wherein the step of establishing said back pressure further includes blocking the passage of air bubbles through the nozzle while sucking said excess ink into the nozzle.

20. The method of claim 18, further including the steps of:

providing on the pen a shutter that is movable between a reservoir closed position and a reservoir open position to provide access to the reservoir;

moving the shutter to the reservoir open position prior to the coupling of the nozzle and pen; and moving the shutter to the reservoir closed position after decoupling of the nozzle and pen.

21. The method of claim 18 wherein the step of providing an ink cartridge includes providing the nozzle with a valve having an open state and a closed state, and providing the nozzle with a compressible portion that is operable to open the nozzle valve when compressed, and wherein the step of coupling the nozzle and the ink pen includes moving the compressible portion of the nozzle into compressive engagement with the pen to open the valve as the nozzle couples with the pen.

* * * * *

UNITED STATES PATENT AND TRADEMARK OFFICE

CERTIFICATE OF CORRECTION

PATENT NO. : 5,912,687
DATED : June 15, 1999
INVENTOR(S) : Cowger et al.

It is certified that error appears in the above-identified patent and that said Letters Patent is hereby corrected as shown below:

Column 10,
Line 45, “which” should read -- while --;

Column 11,
Line 12, “form” should read -- from --.

Signed and Sealed this

Sixth Day of May, 2003

JAMES E. ROGAN
*Director of the United States Patent and Trademark Office*